United States Patent [19]

Luyties

[11] Patent Number: 4,867,611

[45] Date of Patent: Sep. 19, 1989

[54] INSTALLATION OF MULTIPIECE JACKETS USING A LEAD DOCKING POLE

[75] Inventor: William H. Luyties, Kingwood, Tex.

[73] Assignee: Shell Offshore, Inc., Houston, Tex.

[21] Appl. No.: 132,750

[22] Filed: Dec. 14, 1987

[51] Int. Cl.[4] ..... E02B 17/02; E02B 17/00; E02D 21/00; E21B 7/12

[52] U.S. Cl. ..... 405/209; 405/195; 405/204; 405/224; 166/341

[58] Field of Search ..... 405/169, 195, 204, 209, 405/224, 225, 227; 166/338, 341, 343, 352

[56] References Cited

U.S. PATENT DOCUMENTS

| | | | |
|---|---|---|---|
| 3,545,539 | 12/1970 | Manning | 405/169 X |
| 3,716,994 | 2/1973 | Pogonowski | 405/204 |
| 3,859,806 | 1/1975 | Guy et al. | 405/204 |
| 4,426,173 | 1/1984 | Richart et al. | 405/195 |
| 4,541,755 | 9/1985 | Castel et al. | 405/195 |
| 4,607,982 | 8/1986 | Brasted et al. | 405/204 |
| 4,669,918 | 6/1987 | Riles | 405/227 |

FOREIGN PATENT DOCUMENTS

| | | | |
|---|---|---|---|
| 94509 | 6/1983 | Japan | 405/204 |
| 195966 | 5/1965 | Sweden | 405/204 |

OTHER PUBLICATIONS

"Construction of the Cognac Platform, 1025 Feet of Water, Gulf of Mexico," G. H. Sterling, A. O. P. Casbarian & Assoc., N. L. Dodge, D. C. Godfrey, presented at the 11th Annual OTC, Apr. 30–May 3, 1979, Publication No. OTC 3493.

"Development of an Alignment System for the Three--Part Cognac Platform Jacket," E. S. Piter, Lowell Johnston & Assoc., G. H. Sterling, B. E. Cox, presented at the 11th Annual OTC, Apr. 30–May 3, 1979, Publication No. OTC 3496.

*Primary Examiner*—Randolph A. Reese
*Assistant Examiner*—John A. Ricci
*Attorney, Agent, or Firm*—Mark A. Smith

[57] ABSTRACT

Both an offshore platform mating system and method are disclosed in which adjacent first and second jacket sections are provided with a plurality of corresponding docking poles and receptacles, respectively. Alignment of the adjacent jacket sections is facilitated by using at least one extended or lead docking pole on the first jacket section which projects further toward the second jacket section than do the other docking poles and is thus the first to engage one of the horizontally aligned receptacles when the first and second jacket sections vertically approach. Mating procedures for the first and second jacket sections continue with rotational alignment of the first and second jacket sections about the lead docking pole which acts as a pivot while alignment of the other receptacles is adjusted with respect to the other docking poles. The first and second jacket sections are then brought closer and further docking poles and receptacles are brought together and the load is transferred between structural bearing members.

12 Claims, 5 Drawing Sheets

FIG.1
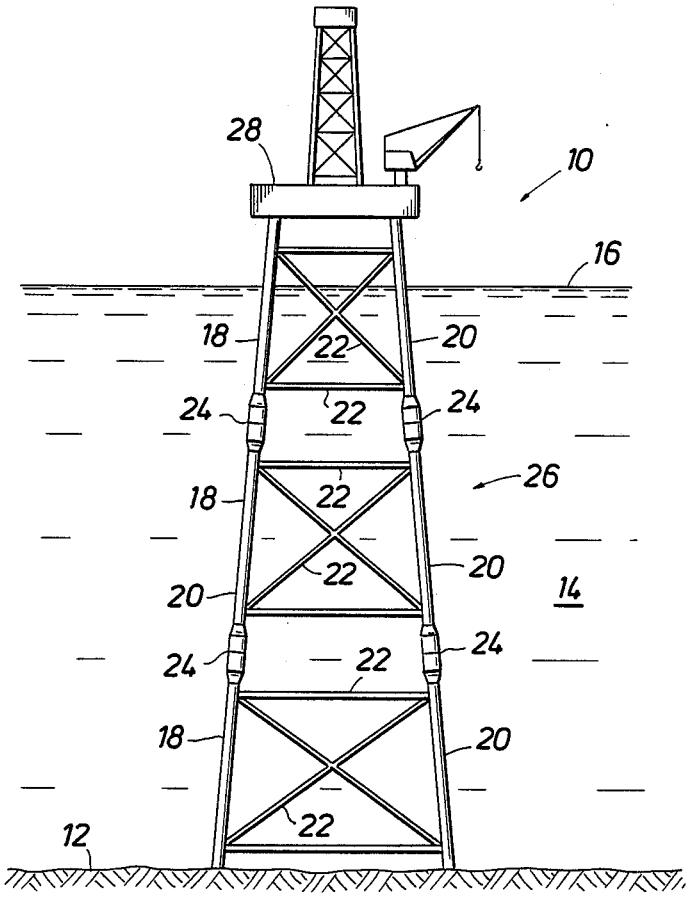
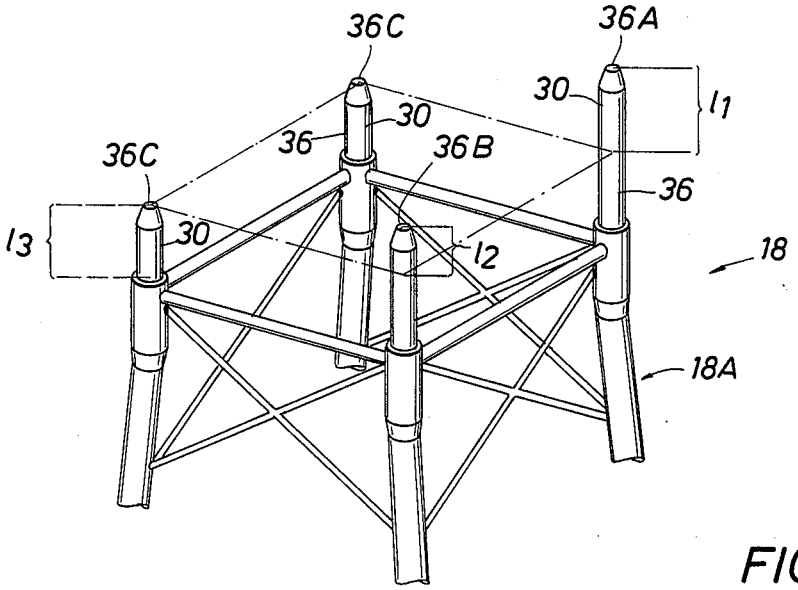
FIG. 2

20
20
22
18A
22
18
36C
36A
24
36C
24
24
38
24
36B
38
38
18B
18
20
20

52
50
54
56
56
18B
38
38A
36
36A
18A
58
58

INSTALLATION OF MULTIPIECE JACKETS USING A LEAD DOCKING POLE

BACKGROUND OF THE INVENTION

This invention relates to the installation of an offshore platform of the type used for oil and gas drilling and/or production operations. More particularly, this invention relates to the mating of a plurality of prefabricated jacket sections during the installation of an offshore platform.

Construction costs for offshore platforms favor onshore construction, with deep water installation providing difficult handling, transportation, launching and upending procedures for placing a prefabricated tower structure at the selected site. Therefore, the use of prefabricated, stackable jacket sections provides an alternative responsive to both onshore construction costs and offshore transportation, handling and installation costs. However, multipiece jacket platform installations require that the respective jacket sections or stages be mated on site. The mating system must guide the jacket sections together to join load-bearing members and to hold the jacket sections in place until the jacket sections are securely interconnected.

In the past, the lowermost jacket section or jacket bottom section is first deployed and secured to the ocean floor. Docking poles and corresponding receptacles carried on respective jacket sections have been used to aid the mating process as succeeding jacket sections are stacked in a vertical assembly. However, the prior art mating process has proceeded with a substantially horizontally coplanar array of substantially vertical outboard docking poles carried on a first jacket member engaging a corresponding substantially horizontally coplanar array of substantially vertical receptacles of a second jacket section as the first and second jacket sections are joined. A successful deployment in this method requires simultaneous alignment of each corresponding pair within these respective arrays at a single touchdown. However, such alignment is difficult to achieve and sustain while approaching touchdown. The effects of wave action on both jacket sections and any surface vessels controlling the operation, shifts in buoyancy during deployment, currents, and normal deflection inherent in deployment of a structure as massive as many jacket sections render total alignment for all points at touchdown a difficult requirement.

Further, minor misalignment can produce disastrous results. The docking poles and receptacles are particularly disposed to damage from misaligned landing, but even major structural components of the jacket sections are jeopardized. Further, correction can be difficult and a failure to fully correct misalignment problems can compromise the structural integrity of the entire offshore platform. Thus, the all-points landing technique risks substantial redeployment and repair costs.

Clearly there is a need for a simpler technique and facilitating apparatus for mating prefabricated multipiece jacket sections in the construction of offshore platforms.

SUMMARY OF THE INVENTION

It is therefore an object of the present invention to provide an improved system and method of mating prefabricated multipiece jacket sections at an offshore site for the installation of an offshore platform which reduces the risk of damage to the jacket sections during initial deployment.

Another object of the present invention is to provide a system and method for mating prefabricated multipiece jacket sections in the construction of an offshore platform which facilitates proper alignment of the jacket sections.

Finally, it is an object of the present invention to provide a system and method for mating prefabricated multipiece jacket sections which reduces the installation time of the offshore platform.

Toward the fulfillment of these and other objects according to the offshore platform mating system and method of the present invention, adjacent first and second jacket sections are provided with a plurality of corresponding docking poles and receptacles, respectively. Alignment of the adjacent jacket sections is facilitated by using at least one extended or lead docking pole on the first jacket section which projects further toward the second jacket section than do the other docking poles and is thus the first to engage one of the horizontally aligned receptacles when the first and second jacket sections vertically approach. Mating procedures for the first and second jacket sections continue with rotational alignment of the first and second jacket sections about the lead docking pole which acts as a pivot while alignment of the other receptacles is adjusted with respect to the other docking poles. The first and second jacket sections are then brought closer and further docking poles and receptacles are brought together.

BRIEF DESCRIPTION OF THE DRAWINGS

The above brief description, as well as further objects, features, and advantages of the present invention, will be more fully appreciated by reference to the following detailed description of the presently preferred, but nonetheless illustrative, embodiment of the present invention with reference to the accompanying drawings in which:

FIG. 1 is a side elevational view of an offshore platform installed from multipiece jacket sections;

FIG. 2 is a perspective view of a first jacket section constructed in accordance with the present invention;

DETAILED DESCRIPTION OF THE PREFERRED EMBODIMENTS

Figure 4:
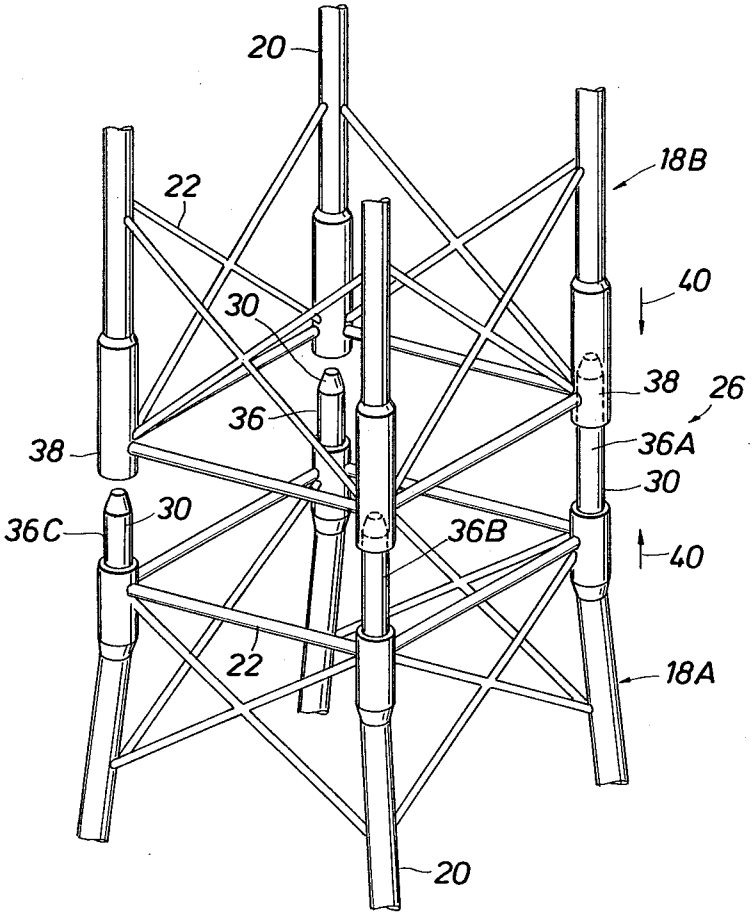
FIG. 4 is a perspective view of the mating of first and second jacket sections at a stage in which the primary and secondary lead docking poles are engaged.

Referring to FIG. 1, the reference character 10 refers generally to an offshore platform constructed in accordance with the present invention from multipiece jacket sections 18. The offshore platform is founded upon ocean floor 12 to stand in water 14 so as to project an uppermost section above water surface 16. Each jacket section 18 connects a plurality of leg portions 20 with struts and brace members 22 in a formation of prefabricated units. The prefabricated units of the respective jacket sections 18 are joined across structural bearing members 24 at which leg portions 20 of adjacent jacket sections 18 are structurally connected. Thus, the prefabricated jacket sections are stacked into an overall tower structure 26 which supports a platform 28 for drilling and/or production operations relating to commercial development of hydrocarbon reserves.

FIG. 2 illustrates a preferred embodiment of one of jacket sections 18 provided at the junction of two mating jacket sections. The jacket section of this illustration has been designated first jacket section 18A as the jacket section bearing a plurality of docking poles 36 which project vertically therefrom. In this preferred embodiment, docking poles 36 also serve as mating pins 30 and are integral to the structural bearing members 24 upon joining a successive jacket section 18.

Central to the present invention is the extended length of at least one of the docking poles 36 to form primary lead docking pole 36A. Further, in the preferred embodiment, a secondary lead docking pole 36B is provided which projects vertically from the first jacket section 18A a length $l_2$ further than the length $l_3$ of the remaining docking poles 36C, but not as far as primary lead docking pole 36A which projects a length $l_1$ further than the length of remaining docking poles 36C.

Figure 3:
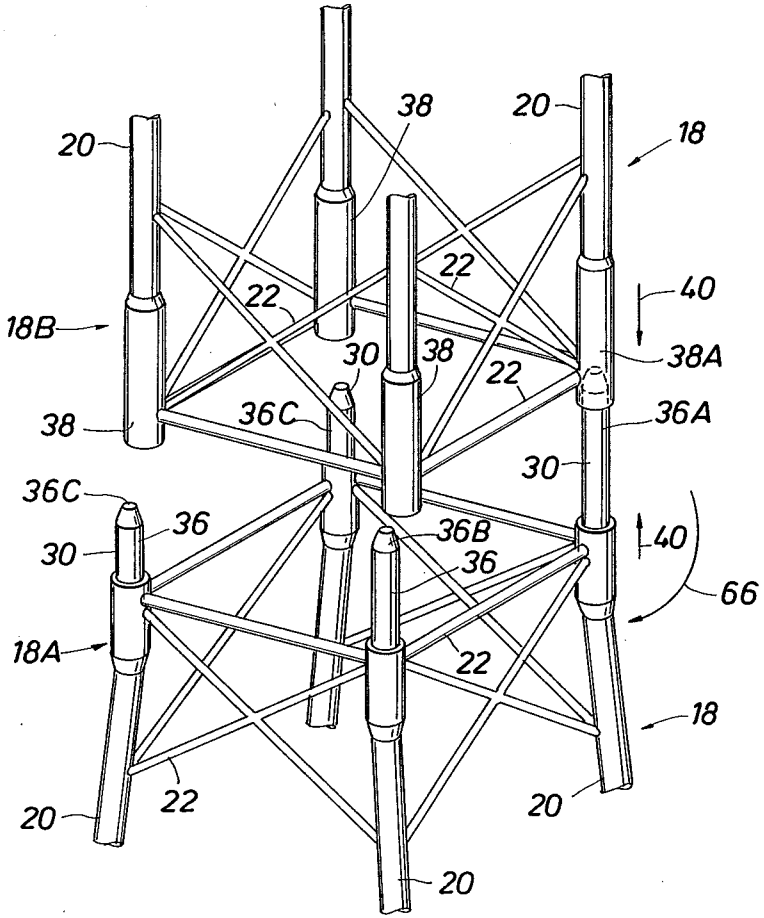
FIG. 3 is a perspective view of the mating of a second jacket section to a first jacket section in accordance with the present invention in which a primary lead docking pole is engaged and the second jacket section is being aligned for mating a secondary lead docking pole.

A jacket section 18 bearing docking pole receiving receptacles 38 is denoted as second jacket section 18B in FIG. 3. In the preferred embodiment, each of receptacles 38 are presented in a substantially horizontal planar array such that differences in arrival time between corresponding docking poles 36 and receptacles 38 of vertically approaching first and second jacket jackets is a function of the extended lengths of primary and secondary docking poles 36A and 36B, respectively, with respect to remaining docking poles 36C.

FIG. 3 illustrates first and second jacket sections 18A and 18B, respectively, vertically approaching one another until the point is reached that primary lead docking pole 36A on first jacket section 18A engages the corresponding receptacle 38, lead receptacle 38A, of second jacket section 18B. Arrows 40 denote the relative vertical approach of the first and second jacket sections resulting in this position. Preferably, this vertical approach is established by lowering the jacket upper section, here second jacket section 18B, onto the jacket lower section, here first jacket section 18A. Various homing techniques known to those skilled in the art may be employed to accurately control this one-point landing for mating primary lead docking pole 36A within its corresponding receptacle 38.

Arrow 66 denotes the realignment of the first and second jacket sections 18A and 18B, respectively, as necessary to rotationally align the remaining docking poles 36 with their respective corresponding receptacles 38 by pivoting the first and second jacket sections, relative to each other, about the engaged primary lead docking pole 36A.

In the preferred embodiment, the jacket lower section, here docking pole carrying first jacket section 18A, is either secured to the ocean floor or secured on top of one or more other jacket sections which are ultimately secured to the ocean floor, and rotation is imparted to the jacket upper section, here second jacket section 18B. It should be apparent that, depending upon water depth, additional jacket sections 18 may be sequentially added, each providing a first and second jacket section relative to that joint.

Figure 6:
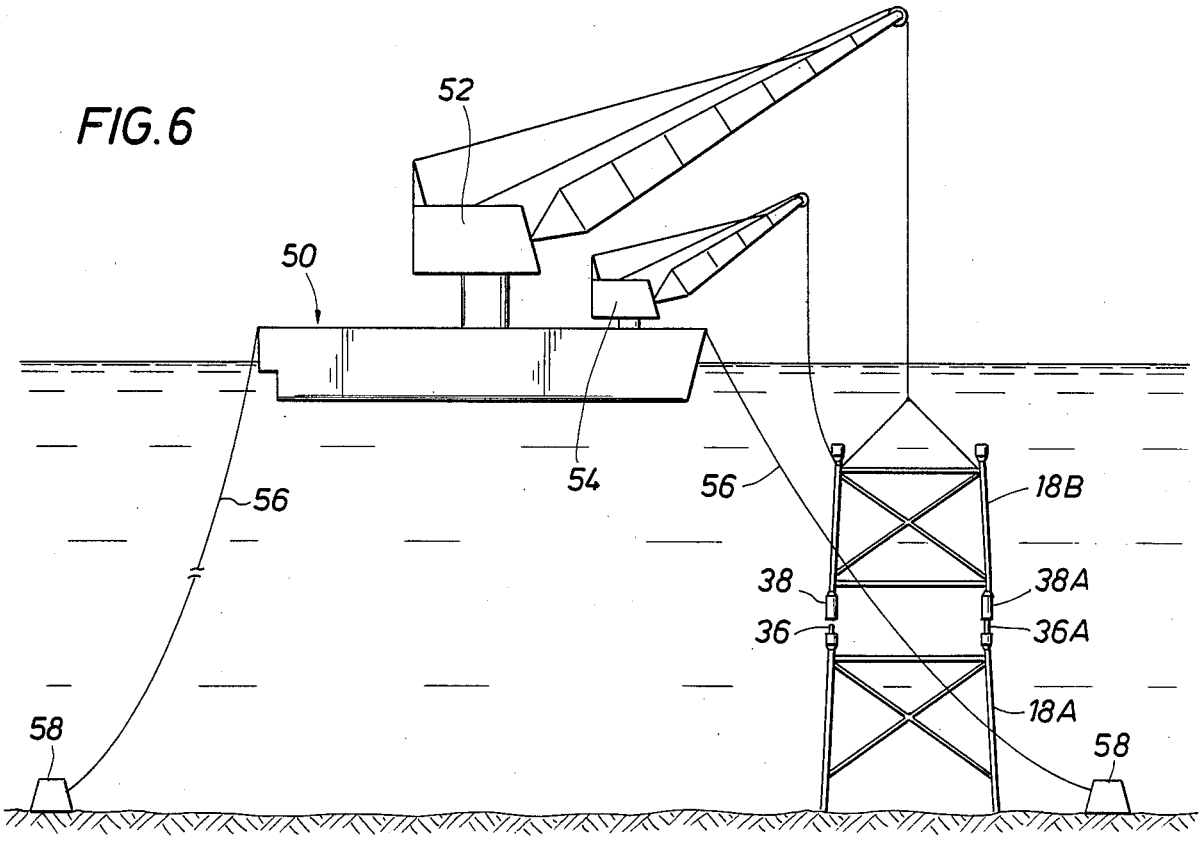
FIG. 6 is a side elevational view of an offshore platform during mating of first and second jacket sections in accordance with the present invention.
Figure 7:
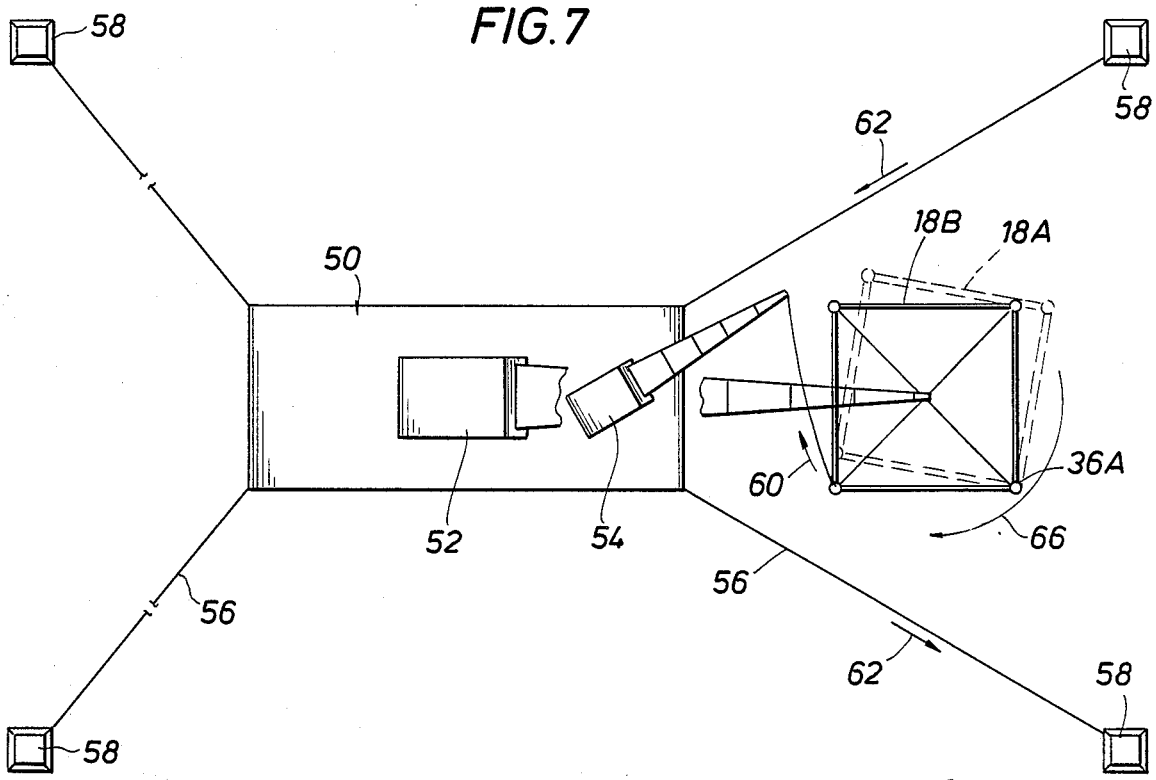
FIG. 7 is an overhead planar view of an offshore platform during the mating procedures illustrated in FIG. 2 in which first and second jacket sections are joined in accordance with the present invention.
Figure 8:
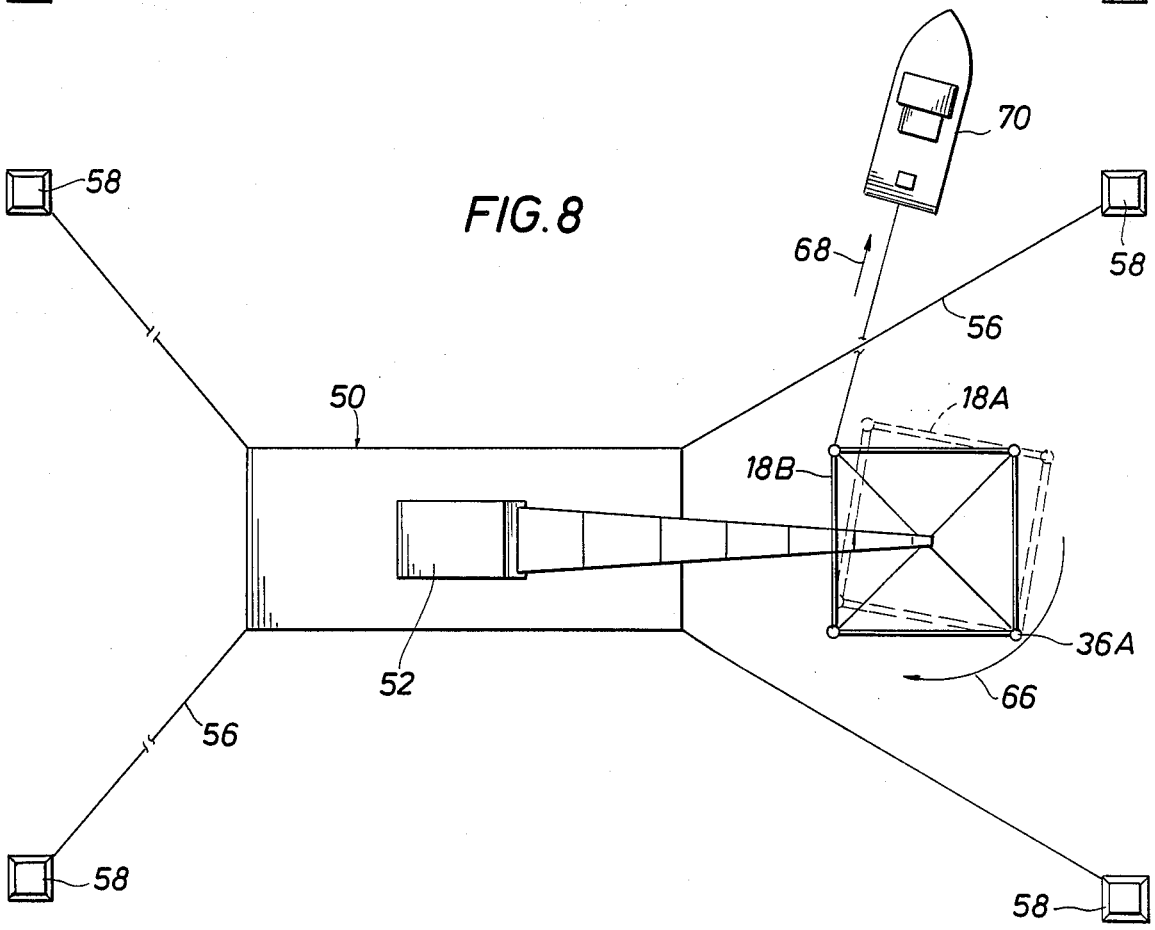
FIG. 8 is an overhead view of another embodiment for realigning first and second jacket sections as necessary to rotationally align the remaining docking poles and corresponding receptacles after engagement of the primary lead docking pole.

Various methods for rotating the upper jacket section are possible and a selection is illustrated in FIGS. 6 through 8. In the schematic illustration of FIG. 6, a very large barge 50 carries two cranes or other hoisting equipment 52 and 54 for mating prefabricated first and second jacket sections 18A and 18B, respectively, as illustrated in FIG. 3. The barge is held in position with the plurality of mooring lines 56 leading to an array of anchors 58. Preferably, the second jacket section is lowered with ballast control and hoisting equipment 52 until primary lead docking pole 36A engages corresponding receptacle 38A. Alternative methods such as ballast control alone are also possible. At this point, lowering operations through which the first and second jacket sections vertically approach one another may be paused to permit realigning the first and second jacket sections as necessary to rotationally align the remaining docking poles 36 with their corresponding receptacles 38.

Procedures in this embodiment for pivoting second jacket section 18B about primary lead docking pole 36A are best illustrated in the overhead view of FIG. 7. The realignment of first and second jacket sections can be accomplished by means of second crane 54 as illustrated with arrow 60. Thus, the primary support from high capacity hoist system 52 continues to support second jacket section 18B at the level at which only the primary lead docking pole is engaged while an eccentrically-arranged line from hoisting system 54 imparts a rotational force to the second jacket section.

Figure 7A:
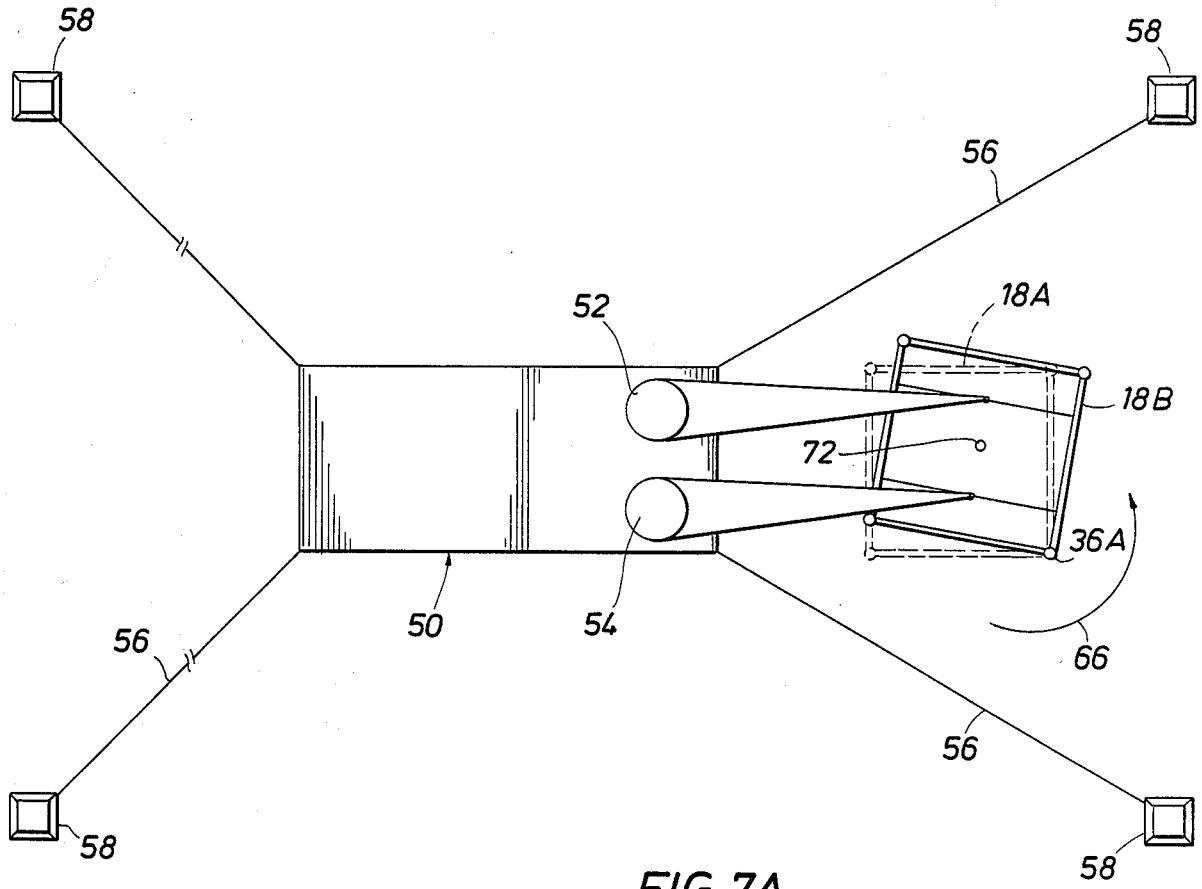
FIG. 7A is an overhead planar view of another embodiment for realigning first and second jacket sections in accordance with the present invention.

In the presently preferred embodiment, each of hoisting systems 52 and 54 support the second jacket section eccentrically to center of gravity 72 and the relative position of these hoisting systems is used to rotate the second jacket section into alignment. See FIG. 7A.

Alternatively, the position of barge 50 may be shifted, thereby moving the position of hoisting equipment 52 with respect to first jacket section 18A. This may be accomplished by taking in and letting out mooring lines 56 as necessary to change the position of barge 50 within the pattern of anchors 58. This shifting of anchor pattern has been denoted with arrows 62. Of course, a similar result could be obtained by the use of a dynamic positioning device within barge 50.

Another dynamic positioning device is illustrated schematically the overhead view of FIG. 8. Here again, a high capacity hoisting system 52 is used to support second jacket section 18B, but the rotational force is provided by a tugboat 70 as illustrated with arrow 68 to achieve a rotation designated by arrow 66 about primary lead docking pole 36A. Of course, this system requires an interface of the tugboat to the jacket section above waterline and is not conducive to intermediate jacket sections which may not extend above the water line.

Returning to the progression of FIGS. 2 through 4, FIG. 4 illustrates the further vertical approach of first and second jacket sections 18A and 18B with respect to one another until secondary lead docking pole 36B is engaged. This secures the rotational orientation of second jacket section 18B with respect to first jacket section 18A and further vertical approach will seat the remaining docking poles 36C within their respective receptacles 38 and bring the necessary structural bearing members within the respective leg portions 20 into proper interface for supporting the tower 26. See FIG. 1.

Figure 5:
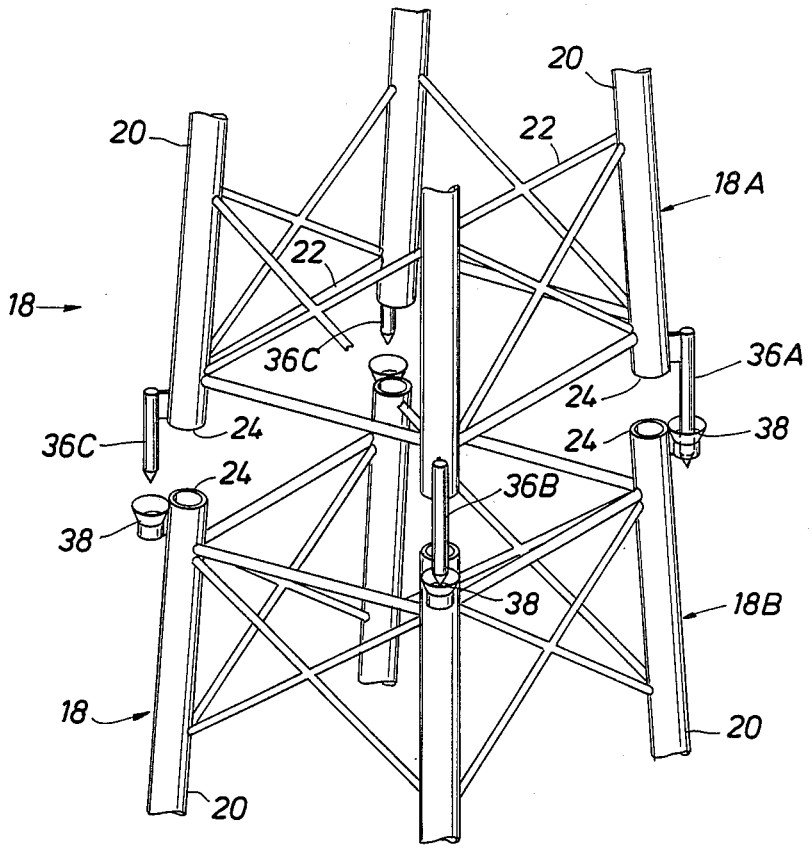
FIG. 5 is a perspective view of an alternate embodiment of a mating system for joining first and second jacket sections in the installation of an offshore platform.

In the discussion above, each of docking poles 36 was provided by a mating pin 30 and was thereby integral to the structural bearing members being joined. However, this is not necessarily the case and FIG. 5 illustrates an alternative embodiment wherein the docking poles are carried outboard of leg portions 20 of jacket sections 18. These docking poles 36 and receptacles 38 provide an alignment means separate from the major structural bearing members 24. Nevertheless, the docking poles and receptacles provide the benefits discussed above in mating first and second jacket sections 18A and 18B, even though the docking poles are not mating pins within the legs of the tower being constructed. Another difference in this embodiment is that the jacket lower section at each junction is the receptacle bearing second jacket section, while the docking pole bearing first jacket section provides the jacket upper section for that junction.

The present system and method of installing multipiece jackets provides a more controlled touchdown by limiting the degrees of freedom which must be simultaneously and externally constrained from the surface as the respective jacket sections are mated and structural bearing members accept the load at touchdown. By sequentially and progressively limiting the degrees of freedom through which surface control must place the adjoining jacket sections in proper alignment, the effects of wave action, shifts in buoyancy, normal deflection, and other imprecision inherent in the process become more manageable.

Other modifications, changes and substitutions are intended in the foregoing disclosure and in some instances, some features of the invention will be employed without a corresponding use of other features. Accordingly, it is appropriate that the appended claims be construed broadly and in a manner consistent with the spirit and scope of the invention herein.

What is claimed is:

1. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, wherein causing the first and second jacket sections to vertically approach one another comprises:

supporting the first jacket section upon a floor of a body of water; and lowering the second jacket section onto the first jacket section;

realigning the first and second jacket sections as necessary to rotationally align the remaining docking poles and the remaining corresponding receptacles by pivoting the first and second jacket sections about the engaged primary lead docking pole, said realigning of first and second jacket sections comprising:

supporting the second jacket section with a first crane provided on a surface vessel; and rotating the second jacket section with a second crane provided by the surface support vessel; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

2. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, wherein causing the first and second jacket sections to vertically approach one another comprises:

supporting the first jacket section upon a floor of a body of water; and lowering the second jacket section onto the first jacket section;

realigning the first and second jacket sections as necessary to rotationally align the remaining docking poles and the remaining corresponding receptacles by pivoting the first and second jacket sections about the engaged primary lead docking pole, said realigning of first and second jacket sections comprising:

supporting the second jacket section with at least two hoisting systems provided on a support vessel, each hoisting system attached to the second jacket section eccentric to its center of gravity; and rotating the second jacket section by adjusting the relative position of the hoisting systems; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

3. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, wherein causing the first and second jacket sections to vertically approach one another comprises:

supporting the first jacket section upon a floor of a body of water; and lowering the second jacket section onto the first jacket section;

realigning the first and second jacket sections as necessary to rotationally align the remaining docking poles and the remaining corresponding receptacles by pivoting the first and second jacket sections about the engaged primary lead docking pole, said realigning of first and second jacket sections comprising:

supporting the second jacket section with a crane provided on a surface support vessel; and moving the surface support vessel; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

4. A method for mating the first and second jacket sections during installation of an offshore platform in accordance with claim 3 wherein moving the surface support vessel comprises:

anchoring the surface support vessel to the ocean floor with a plurality of anchors connected to the surface support vessel by mooring lines; and moving the surface support vessel within the anchor pattern by adjusting the length of the mooring lines.

5. A method for mating first and second jacket sections in the installation of an offshore platform in accordance with claim 3 wherein moving the surface support vessel comprises deployment of dynamic positioning techniques.

6. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, wherein causing the first and second jacket sections to vertically approach one another comprises:

supporting the first jacket section upon a floor of a body of water; and lowering the second jacket section onto the first jacket section; and realigning the first and second jacket sections as necessary to rotationally align the remaining docking poles and the remaining corresponding receptacles by pivoting the first and second jacket sections about the engaged primary lead docking pole, said realigning of first and second jacket sections comprising manipulation of the second jacket section by at least one tugboat interfacing with the second jacket section above the water line; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

7. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, said causing the first and second jacket sections to vertically approach one another comprising:

securing the second jacket section to a floor of a body of water; and lowering the first jacket section onto the first jacket section;

realigning the first and second jacket sections as necessary to rotationally align the remaining docking poles and the remaining corresponding receptacles by pivoting the first and second jacket sections about the engaged primary lead docking pole, said realigning the first and second jacket sections comprising:

supporting the first jacket section with a first crane provided on a surface vessel; and rotating the first jacket section with a second crane provided by the surface vessel; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

8. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, said causing the first and second jacket sections to vertically approach one another comprising:

securing the second jacket section to a floor of a body of water; and lowering the first jacket section onto the first jacket section;

realigning the first and second jacket sections as necessary to rotationally align the remaining docking poles and the remaining corresponding receptacles by pivoting the first and second jacket sections about the engaged primary lead docking pole, said realigning the first and second jacket sections comprising:

supporting the first jacket section with at least two hoisting systems provided on a support vessel, each hoisting system attached to the first jacket section eccentric to its center of gravity; and rotating the first jacket section by adjusting the relative position of the hoisting systems; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

9. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, said causing the first and second jacket sections to vertically approach one another comprising:

securing the second jacket section to a floor of a body of water; and lowering the first jacket section onto the first jacket section;

realigning the first and second jacket sections as necessary to rotationally align the remaining docking poles and the remaining corresponding receptacles by pivoting the first and second jacket sections about the engaged primary lead docking pole, said realigning the first and second jacket sections as necessary to rotationally align the remaining docking poles and corresponding receptacles comprising:

supporting the first jacket section with a crane provided on a surface support vessel; and moving the surface support vessel; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

10. A method for mating first and second jacket sections during installation of an offshore platform in accordance with claim 9 wherein moving the surface support vessel comprises:

anchoring the surface support vessel to the ocean floor with a plurality of anchors connected to the surface support vessel by mooring lines; and moving the surface support vessel within the anchor pattern by adjusting the length of the mooring lines.

11. A method for mating first and second jacket sections in the installation of an offshore platform in accordance with claim 9 wherein moving the surface support vessel comprises deployment of dynamic positioning techniques.

12. A method for mating in vertical orientation a first and a second jacket section, said method comprising:

providing a plurality of vertically projecting docking poles on the first jacket section, one of said docking poles being extended to form a primary lead docking pole;

providing a plurality of receptacles on the second jacket section disposed to vertically receive the docking poles during mating of the first and second jacket sections;

causing the first and second jacket sections to vertically approach one another until the primary lead docking pole on the first jacket section engages the corresponding receptacle on the second jacket section, said causing the first and second jacket sections to vertically approach one another comprising:

securing the second jacket section to a floor of a body of water; and lowering the first jacket section onto the first jacket section;

realigning the first and second jacket sections as necessary to rotationally align the remaining docking poles and the remaining corresponding receptacles by pivoting the first and second jacket sections about the engaged primary lead docking pole, said realigning the first and second jacket sections comprising manipulation of the first jacket section by at least one tugboat interfacing with the second jacket section above the water line; and causing the first and second jacket sections to further vertically approach one another while preserving the rotational alignment between the first and second jacket sections as further docking poles and corresponding receptacles are brought into engagement and a plurality of first and second structural bearing members are thereby guided into engagement.

* * * * *